US007612971B2

(12) United States Patent
Premerlani et al.

(10) Patent No.: US 7,612,971 B2
(45) Date of Patent: Nov. 3, 2009

(54) MICRO-ELECTROMECHANICAL SYSTEM BASED SWITCHING IN HEATING-VENTILATION-AIR-CONDITIONING SYSTEMS

(75) Inventors: William James Premerlani, Scotia, NY (US); Kanakasabapathi Subramanian, Clifton Park, NY (US); Daniel Takashi Nakano, Avon, CT (US)

(73) Assignee: General Electric Company, Schenectady, NY (US)

( * ) Notice: Subject to any disclaimer, the term of this patent is extended or adjusted under 35 U.S.C. 154(b) by 182 days.

(21) Appl. No.: 11/763,631

(22) Filed: Jun. 15, 2007

(65) Prior Publication Data

US 2008/0308254 A1 Dec. 18, 2008

(51) Int. Cl.
*H02H 7/09* (2006.01)

(52) U.S. Cl. ..... 361/33; 361/2; 318/723

(58) Field of Classification Search ..... 361/33, 361/2; 318/723
See application file for complete search history.

(56) References Cited

U.S. PATENT DOCUMENTS

| | | | | |
|---|---|---|---|---|
| 3,496,409 | A | 2/1970 | Connell | 315/36 |
| 4,384,289 | A | 5/1983 | Stillwell et al. | |
| 4,723,187 | A | 2/1988 | Howell | |
| 4,827,272 | A | 5/1989 | Davis | |
| 4,847,780 | A | 7/1989 | Gilker et al. | |
| 5,374,792 | A | 12/1994 | Ghezzo et al. | |
| 5,426,360 | A | 6/1995 | Maraio et al. | |
| 5,430,597 | A | 7/1995 | Bagepalli et al. | 361/93 |
| 5,454,904 | A | 10/1995 | Ghezzo et al. | |
| 5,502,374 | A | 3/1996 | Cota | |
| 5,889,643 | A | 3/1999 | Elms | |
| 5,940,260 | A | 8/1999 | Gelbien et al. | |
| 5,943,223 | A | 8/1999 | Pond | |
| 5,973,896 | A | 10/1999 | Hirsh et al. | |
| 6,054,659 | A | 4/2000 | Lee et al. | |
| 6,275,366 | B1 | 8/2001 | Gelbien et al. | |
| 6,563,683 | B1 | 5/2003 | Strumpler | 361/93.1 |
| 6,738,246 | B1 | 5/2004 | Strumpler | 361/93.1 |
| 6,904,471 | B2 | 6/2005 | Boggs et al. | 710/8 |
| 7,200,502 | B2 * | 4/2007 | Gasperi et al. | 702/65 |
| 2001/0014949 | A1 | 8/2001 | Leblanc | |
| 2002/0008149 | A1 | 1/2002 | Riley et al. | |

(Continued)

FOREIGN PATENT DOCUMENTS

DE 19850397 A1 5/2000

(Continued)

OTHER PUBLICATIONS

"Power Circuit Breaker Using Micro-Mechanical Switches"; Authors: George G. Karady and Gerald Thomas Heydt; Int J. Critical Infrastructure, vol. 3, Nos. 1/2, 2007; pp. 88-100; XP008087882.

(Continued)

*Primary Examiner*—Bentsu Ro
*Assistant Examiner*—Erick Glass
(74) *Attorney, Agent, or Firm*—Cantor Colburn LLP

(57) ABSTRACT

HVAC systems implementing micro-electromechanical system based switching devices. Exemplary embodiments include a HVAC system, including a load motor, a main breaker micro electromechanical system (MEMS) switch, and a variable frequency drive (VFD) disposed between and electrically coupled to the load motor and the main breaker MEMS switch.

21 Claims, 5 Drawing Sheets

U.S. PATENT DOCUMENTS

| | | | | |
|---|---|---|---|---|
| 2002/0145841 | A1 | 10/2002 | Williams et al. | |
| 2003/0050737 | A1 | 3/2003 | Osann, Jr. | |
| 2003/0212473 | A1 | 11/2003 | Vandevanter | |
| 2004/0032320 | A1 | 2/2004 | Zalitzky et al. | |
| 2004/0113713 | A1 | 6/2004 | Zipper et al. | |
| 2004/0252423 | A1* | 12/2004 | Boren | 361/23 |
| 2004/0263125 | A1 | 12/2004 | Kanno et al. | |
| 2005/0035664 | A1* | 2/2005 | Zver et al. | 307/115 |
| 2005/0085928 | A1 | 4/2005 | Shani | 700/18 |
| 2005/0248340 | A1 | 11/2005 | Berkcan et al. | 324/259 |
| 2005/0270014 | A1 | 12/2005 | Zribi et al. | |
| 2006/0121785 | A1 | 6/2006 | Caggiano et al. | |
| 2006/0187688 | A1 | 8/2006 | Tsuruya | 363/56.12 |
| 2006/0202933 | A1 | 9/2006 | Pasch et al. | 345/94 |
| 2007/0013357 | A1 | 1/2007 | Huang et al. | 323/318 |
| 2007/0057746 | A1 | 3/2007 | Rubel | |
| 2007/0142938 | A1 | 6/2007 | Huang | 700/40 |
| 2007/0173960 | A1 | 7/2007 | Kumar | 700/40 |
| 2007/0247140 | A1* | 10/2007 | Mayder et al. | 324/158.1 |
| 2008/0174257 | A1* | 7/2008 | Schnetzka et al. | 318/434 |

FOREIGN PATENT DOCUMENTS

| | | | |
|---|---|---|---|
| DE | 19927762 | A1 | 1/2001 |
| EP | 0072422 | A1 | 2/1983 |
| EP | 0233756 | A1 | 8/1987 |
| EP | 0774822 | A1 | 5/1997 |
| EP | 1255268 | A1 | 11/2002 |
| EP | 1610142 | A1 | 12/2005 |
| EP | 1643324 | A2 | 4/2006 |
| EP | 1681694 | A1 | 7/2006 |
| GB | 2123627 | A | 2/1984 |
| WO | 9946606 | A2 | 9/1999 |
| WO | 0004392 | A1 | 1/2000 |
| WO | 2006078944 | A2 | 7/2006 |
| WO | 2006100192 | A1 | 9/2006 |

OTHER PUBLICATIONS

"MEMS Based Electronic Circuit Breaker as a Possible Component for and Electrical Ship", Authors: George G. Karady and Gerald T. Heydt; IEEE Electric Ship Technologies Symposium, 2005; pp. 214-218; XP-002468154.

"Advanced MEMS for High Power Integrated Distribution Systems"; Authors: Rahim Kasim, Bruce C. Kim and Josef Drobnik; IEEE Computer; Proceedings of the International Conference on MEMS, NANO and Smart Systems, 2005; pp. 1-6.

PCT International Search Report; International Application No. PCT/US2007/014379; International Filing Date Jun. 20, 2007; Date of Mailing Feb. 11, 2008.

PCT International Search Report; International Application No. PCT/US2007/071644; International Filing Date Jun. 20, 2007; Date of Mailing Feb. 13, 2008.

PCT International Search Report; International Application No. PCT/US2007/071624; International Filing Date Jun. 20, 2007; Date of Mailing Feb. 18, 2008.

PCT International Search Report; International Application No. PCT/US2007/071627; International Filing Date Jun. 20, 2007; Date of Mailing Feb. 29, 2008.

PCT International Search Report; International Application No. PCT/US2007/071630; International Filing Date Jun. 20, 2007; Date of Mailing Mar. 7, 2008.

PCT Written Opinion of the International Searching Authority; International Application No. PCT/US2007/071630; International Filing Date Jun. 20, 2007; Date of Mailing Mar. 7, 2008.

PCT International Search Report; International Application No. PCT/US2007/071632; International Filing Date Jun. 20, 2007; Date of Mailing Feb. 29, 2008.

PCT Written Opinion of the International Searching Authority; International Application No. PCT/US2007/071632; International Filing Date Jun. 20, 2007; Date of Mailing Feb. 29, 2008.

PCT International Search Report; International Application No. PCT/US2007/014363; International Filing Date Jun. 20, 2007; Date of Mailing Mar. 4, 2008.

PCT International Search Report; International Application No. PCT/US2007/071656; International Filing Date Jun. 20, 2007; Date of Mailing Mar. 12, 2008.

PCT International Search Report; International Application No. PCT/US2007/071654; International Filing Date Jun. 20, 2007; Date of Mailing Mar. 13, 2008.

PCT International Search Report; International Application No. PCT/US2007/014362; International Filing Date Jun. 20, 2007; Date of Mailing Mar. 20, 2008.

PCT International Search Report; International Application No. PCT/US2007/071643; International Filing Date Jun. 20, 2007; Date of Mailing Feb. 8, 2008.

PCT Written Opinion of the International Searching Authority; International Application No. PCT/US2007/071643; International Filing Date Jun. 20, 2007; Date of Mailing Feb. 8, 2008.

USPTO Office Action dated Oct. 17, 2008; Filing Date: Jun. 19, 2007; First Named Inventor: William James Premerlani; Confirmation No. 6421.

USPTO Office Action dated Oct. 24, 2008; Filing Date: Jun. 15, 2007; First Named Inventor: William James Permerlani; Confirmation No. 4167.

USPTO Office Action dated Oct. 28, 2008; Filing Date: Jun. 8, 2007; First Named Inventor: Cecil Rivers, Jr; Confirmation No. 7895.

George G. Karady and G.T. Heydt, "Novel Concept for Medium Voltage Circuit Breakers Using Microswitches," IEEE Transactions on Power Delivery, vol. 21, No. 1, Jan. 2006.

European Search Report for European Application No. 07110554.8; European Filing Date of Oct. 19, 2007; Date of Mailing Oct. 30, 2007; (6 pgs).

* cited by examiner

MICRO-ELECTROMECHANICAL SYSTEM BASED SWITCHING IN HEATING-VENTILATION-AIR-CONDITIONING SYSTEMS

BACKGROUND OF THE INVENTION

Embodiments of the invention relate generally to beating-ventilation-air-conditioning (HVAC), and more particularly to HVAC systems implementing micro-electromechanical system based switching devices.

Conventionally, variable speed packaged drives for heating-ventilation-air-conditioning (HVAC) applications contain several auxiliary power handling components besides the core electronics to provide complete functionality. A main breaker is provided to turn the entire HVAC system on or off and to protect the entire HVAC system, including the connected motor load, from faults. Contactors are provided to bypass the power electronics to allow the motor load to be directly connected to the source of power. In addition, fuses are provided to protect the motor and it's cabling from short circuits.

The main breaker provides isolation, protection, and control functions for all downstream components. Conventionally, the main breaker implements conventional circuit breakers, which are slow to respond, are large, noisy, and let through a dangerous amount of current during faults, resulting in significant arc-flash hazard. While circuit breakers provide similar protection and the convenience of being able to be reset rather than replaced alter they operate or trip, they typically include complex mechanical systems with comparatively slow response times, in relation to fuses, and less selectivity between upstream and downstream circuit breakers during short circuit faults.

The electronic fault sensing method in breakers having electronic trip units typically involves some computation time that increases the decision time and thus reaction time to a fault. In addition, once the decision is made to trip, the mechanical systems are comparatively slow to respond due to mechanical inertia. Accordingly, in response to a short-circuit, a circuit breaker can allow comparatively larger amounts of energy (known as let-through energy) to pass through the circuit breaker.

Fuses are typically more selective than circuit breakers and provide less variation in response to short circuit conditions, but must be replaced after they perform their protective functions. Fuses are designed with series elements that melt at a prescribed over-current and thus open the current path. Fuses come in many shapes and sizes but are designed into fuse holders that allow them to snap-in and snap-out for ease of replacement. Manufacturers adhere to standard dimensions for the fuses and holders dependent on the fuse type and rating, making drop-in replacements easy.

A contactor is an electrical device designed to switch an electrical load ON and OFF on command. Traditionally, electromechanical contactors are employed in control gear, where the electromechanical contactors are capable of handling switching currents up to their interrupting capacity. Electromechanical contactors may also find application in power systems for switching currents. However, fault currents in power systems are typically greater than the interrupting capacity of the electromechanical contactors. Accordingly, to employ electromechanical contactors in power system applications, it may be desirable to protect the contactor from damage by backing it up with a series device that is sufficiently fast acting to interrupt fault currents prior to the contactor opening at all values of current above the interrupting capacity of the contactor.

Previously conceived solutions to facilitate use of contactors in power systems include vacuum contactors, vacuum interrupters and air break contactors, for example. Unfortunately, contactors such as vacuum contactors do not lend themselves to easy visual inspection as the contactor tips are encapsulated in a sealed, evacuated enclosure. Further, while the vacuum contactors are well suited for handling the switching of large motors, transformers and capacitors, they are known to cause undesirable transient over-voltages, particularly when the load is switched off.

Furthermore, the electromechanical contactors generally use mechanical switches. However, as these mechanical switches tend to switch at a relatively slow speed, predictive techniques are employed in order to estimate occurrence of a zero crossing, often tens of milliseconds before the switching event is to occur, in order to facilitate opening/closing at the zero crossing for reduced arcing. Such zero crossing prediction is prone to error as many transients may occur in this prediction time interval.

As an alternative to slow mechanical and electromechanical switches, fast solid-state switches have been employed in high speed switching applications. As will be appreciated, these solid-state switches switch between a conducting state and a non-conducting state through controlled application of a voltage or bias. For example, by reverse biasing a solid-state switch, the switch may be transitioned into a non-conducting state. However, since solid-state switches do not create a physical gap between contacts when they are switched into a non-conducing state, they experience leakage current. Furthermore, due to internal resistances, when solid-state switches operate in a conducting state, they experience a voltage drop. Both the voltage drop and leakage current contribute to the generation of excess heat under normal operating circumstances, which may effect switch performance and life. Moreover, due at least in part to the inherent leakage current associated with solid-state switches, their use in circuit breaker applications is not practical.

Accordingly, there exists a need in the art for a current switching circuit protection arrangement to overcome these drawbacks.

BRIEF DESCRIPTION OF THE INVENTION

Disclosed herein is a HVAC system, including a load motor, a main breaker micro electromechanical system (MEMS) switch, and a variable frequency drive (VFD) disposed between and electrically coupled to the load motor and the main breaker MEMS switch.

Further disclosed herein is a HVAC system, including a load motor, a main breaker micro electromechanical system (MEMS) switch, a first MEMS switch branch coupled between the load motor and the main breaker MEMS switch, a second MEMS switch branch coupled between the load motor and the main breaker MEMS switch, and electrically arranged in parallel to the first MEMS switch branch, a variable frequency drive (VFD) disposed on the first MEMS switch branch, a drive MEMS switch disposed on the first MEMS switch branch and in electrical series with the VFD and a bypass MEMS switch disposed on the second MEMS switch branch.

Further disclosed herein is a HVAC system, including a load motor, a main breaker micro electromechanical system (MEMS) switch, a first MEMS switch branch coupled between the load motor and the main breaker MEMS switch, a drive MEMS switch disposed on the first MEMS switch branch, an isolate MEMS switch disposed on the first MEMS switch branch, a variable frequency drive (VFD) disposed on the first MEMS switch branch and between and in electrical series with the drive and isolate MEMS switches, a second MEMS switch branch coupled between the load motor and the main breaker MEMS switch, and electrically arranged in parallel to the first MEMS switch branch and a bypass MEMS switch disposed on the second MEMS switch branch.

BRIEF DESCRIPTION OF THE DRAWINGS

These and other features, aspects, and advantages of the present invention will become better understood when the following detailed description is read with reference to the accompanying drawings In which like characters represent like parts throughout the drawings, wherein.

DETAILED DESCRIPTION OF THE INVENTION

Exemplary embodiments include integrated networks of MEMS microswitch arrays that provide superior protection and bypass functions in variable speed package HVAC drives. The main circuit breaker is replaced with a current limiting array that provides protection for all other components in the package. The current limiting function allows all other components to be sized without regard to fault let-through current. Therefore the fuses can be eliminated entirely, and the contactors can be replaced with MEMS microswitch arrays that are required to carry load current only. The systems described herein provide protection and bypass functions in a variable frequency HVAC drive. Protection includes removing short circuits (faults) anywhere within the drive, including the motor load and the cables connecting to the motor. Bypass function allows direct connection of the motor load to the power supply. In exemplary embodiments, a motor load connected to a power source through a network of MEMS switches, and the electronic variable frequency drive (VFD). A main breaker MEMS switch is used to turn everything on and off and to also provide fault protection for faults anywhere downstream of the breaker. Further MEMS switches bypass the electronics or to energize it. In exemplary embodiments, arc-flash energy for faults anywhere in the package, on the cables, or in the motor are reduced by several orders of magnitude. In exemplary embodiments, the current-handling requirements of the electronic portion of the package (variable frequency drive) are reduced. In exemplary embodiments, coordination of control and protection functions among the several MEMS microswitch arrays such that only one of them is tasked with providing current limiting and power switching functions. All other devices are switched "cold". (No voltage or current while being switched.)

Figure 1:
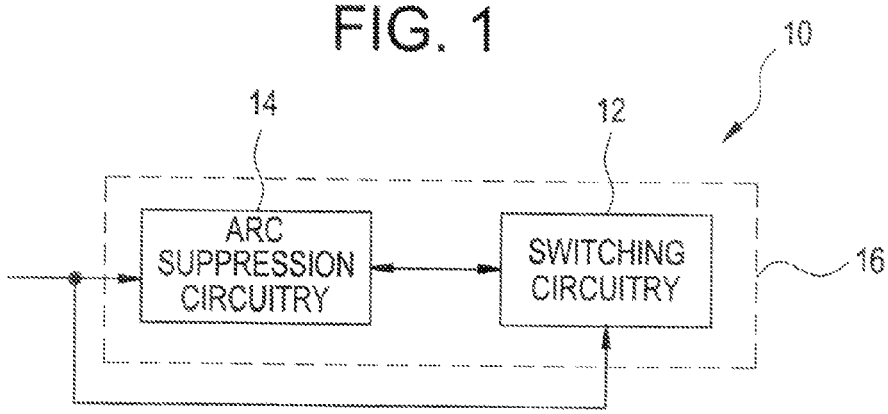
FIG. 1 is a block diagram of an exemplary MEMS based switching system in accordance with an embodiment of the invention.

FIG. 1 illustrates a block diagram of an exemplary arc-less micro-electromechanical system switch (MEMS) based switching system 10, in accordance with aspects of the present invention. Presently, MEMS generally refer to micron-scale structures that for example can integrate a multiplicity of functionally distinct elements, for example, mechanical elements, electromechanical elements, sensors, actuators, and electronics, on a common substrate through micro-fabrication technology. It is contemplated, however, that many techniques and structures presently available in MEMS devices will in just a few years be available via nanotechnology-based devices, for example, structures that may be smaller than 100 nanometers in size. Accordingly, even though example embodiments described throughout this document may refer to MEMS-based switching devices, it is submitted that the inventive aspects of the present invention should be broadly construed and should not be limited to micron-sized devices.

As Illustrated in FIG. 1, the arc-less MEMS based switching system 10 is shown as including MEMS based switching circuitry 12 and arc suppression circuitry 14, where the arc suppression circuitry 14, alternatively referred to as a Hybrid Arcless Limiting Technology (HALT) device, is operatively coupled to the MEMS based switching circuitry 12. In certain embodiments, the MEMS based switching circuitry 12 may be integrated in its entirety with the arc suppression circuitry 14 in a single package 16, for example. In other embodiments, only certain portions or components of the MEMS based switching circuitry 12 may be integrated with the arc suppression circuitry 14.

In a presently contemplated configuration as will be described in greater detail with reference to FIG. 2, the MEMS based switching circuitry 12 may include one or more MEMS switches. Additionally, the arc suppression circuitry 14 may include a balanced diode bridge and a pulse circuit. Further, the arc suppression circuitry 14 may be configured to facilitate suppression of an arc formation between contacts of the one or more MEMS switches by receiving a transfer of electrical energy from the MEMS switch in response to the MEMS switch changing state from closed to open. It may be noted that the arc suppression circuitry 14 may be configured to facilitate suppression of an arc formation in response to an alternating current (AC) or a direct current (DC).

Figure 2:
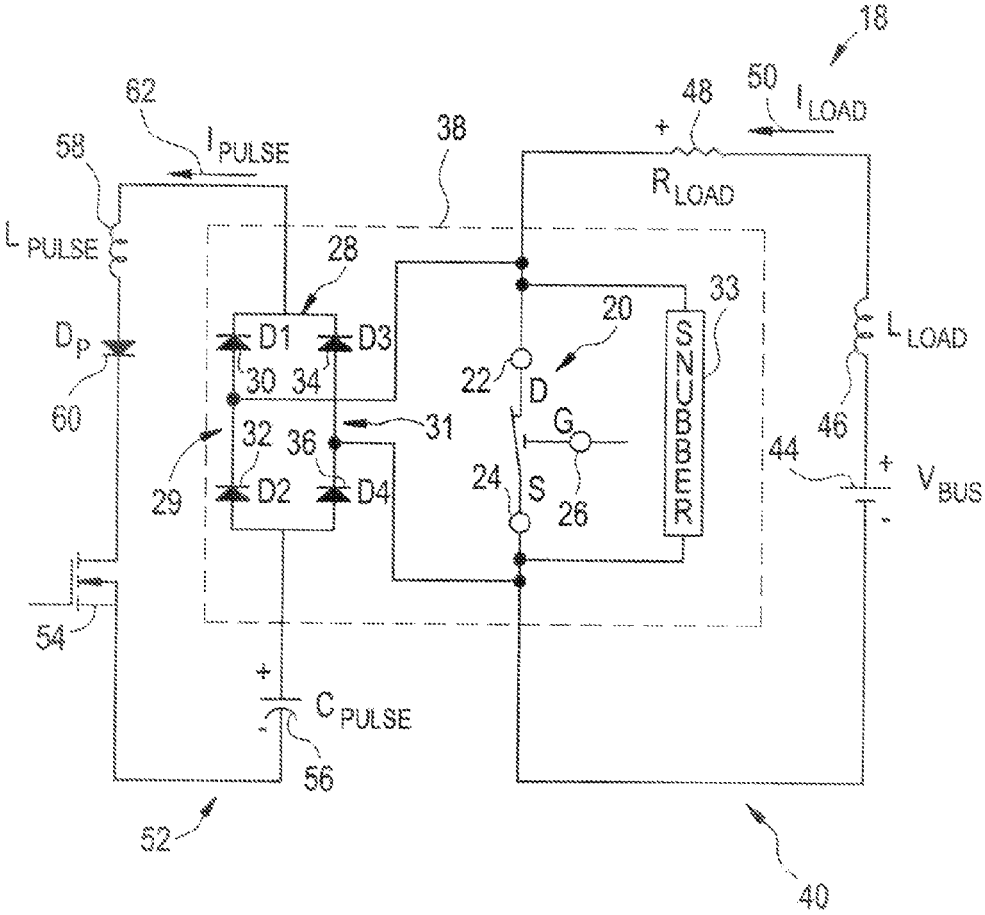
FIG. 2 is schematic diagram illustrating the exemplary MEMS based switching system depicted in FIG. 1.

Turning now to FIG. 2, a schematic diagram 18 of the exemplary arc-less MEMS based switching system depicted in FIG. 1 is illustrated in accordance with one embodiment. As noted with reference to FIG. 1, the MEMS based switching circuitry 12 may include one or more MEMS switches. In the illustrated embodiment, a first MEMS switch 20 is depicted as having a first contact 22, a second contact 24 and a third contact 26. In one embodiment, the first contact 22 may be configured as a drain, the second contact 24 may be configured as a source and the third contact 26 may be configured as a gate. Furthermore, as illustrated In FIG. 2, a voltage snubber circuit 33 may be coupled in parallel with the MEMS switch 20 and configured to limit voltage overshoot during fast contact separation as will be explained in greater detail hereinafter. In certain embodiments, the snubber circuit 33 may include a snubber capacitor (see 76, FIG. 4) coupled in series with a snubber resistor (see 78, FIG. 4). The snubber capacitor may facilitate improvement in transient voltage sharing during the sequencing of the opening of the MEMS switch 20. Furthermore, the snubber resistor may suppress any pulse of current generated by the snubber capacitor during closing operation of the MEMS switch 20. In certain other embodiments, the voltage snubber circuit 33 may include a metal oxide varistor (MOV) (not shown).

In accordance with further aspects of the present technique, a load circuit 40 may be coupled in series with the first MEMS switch 20. The load circuit 40 may include a voltage source $V_{SUS}$ 44. In addition, the load circuit 40 may also include a load inductance 46 $L_{LOAD}$, where the load inductance $L_{LOAD}$ 46 is representative of a combined load inductance and a bus inductance viewed by the load circuit 40. The load circuit 40 may also include a load resistance $R_{LOAD}$ 48 representative of a combined load resistance viewed by the load circuit 40. Reference numeral 50 is representative of a load circuit current $I_{LOAD}$ that may flow through the load circuit 40 and the first MEMS switch 20.

Further, as noted with reference to FIG. 1, the arc suppression circuitry 14 may include a balanced diode bridge. In the illustrated embodiment, a balanced diode bridge 28 is depicted as having a first branch 29 and a second branch 31. As used herein, the term "balanced diode bridge" is used to represent a diode bridge that is configured such that voltage drops across both the first and second branches 29, 31 are substantially equal. The first branch 29 of the balanced diode bridge 28 may include a first diode D1 30 and a second diode D2 32 coupled together to form a first series circuit. In a similar fashion, the second branch 31 of the balanced diode bridge 28 may include a third diode D3 34 and a fourth diode D4 36 operatively coupled together to form a second series circuit.

In one embodiment, the first MEMS switch 20 may be coupled in parallel across midpoints of the balanced diode bridge 28. The midpoints of the balanced diode bridge may include a first midpoint located between the first and second diodes 30, 32 and a second midpoint located between the third and fourth diodes 34, 36. Furthermore, the first MEMS switch 20 and the balanced diode bridge 28 may be tightly packaged to facilitate minimization of parasitic inductance caused by the balanced diode bridge 28 and in particular, the connections to the MEMS switch 20. It may he noted that, in accordance with exemplary aspects of the present technique, the first MEMS switch 20 and the balanced diode bridge 28 are positioned relative to one another such that the inherent inductance between the first MEMS switch 20 and the balanced diode bridge 28 produces a dt/dt voltage less than a few percent of the voltage across the drain 22 and source 24 of the MEMS switch 20 when carrying a transfer of the load current to the diode bridge 28 during the MEMS switch 20 turn-off which will be described in greater detail hereinafter. In one embodiment, the first MEMS switch 20 may be integrated with the balanced diode bridge 28 in a single package 38 or optionally, the same die with the intention of minimizing the inductance interconnecting the MEMS switch 20 and the diode bridge 28.

Additionally, the arc suppression circuitry 14 may include a pulse circuit 52 coupled in operative association with the balanced diode bridge 28. The pulse circuit 52 may be configured to detect a switch condition and initiate opening of the MEMS switch 20 responsive to the switch condition. As used herein, the term "switch condition" refers to a condition that triggers changing a present operating state of the MEMS switch 20. For example, the switch condition may result in changing a first closed state of the MEMS switch 20 to a second open state or a first open state of the MEMS switch 20 to a second closed state. A switch condition may occur in response to a number of actions including but not limited to a circuit fault or switch ON/OFF request.

The pulse circuit 52 may include a pulse switch 54 and a pulse capacitor $C_{PULSE}$ 56 series coupled to the pulse switch 54. Further, the pulse circuit may also include a pulse inductance $L_{PULSE}$ 58 and a first diode $D_P$ 60 coupled in series with the pulse switch 54. The pulse inductance $L_{PULSE}$ 58, the diode $D_P$ 60, the pulse switch 54 and the pulse capacitor $C_{PULSE}$ 56 may be coupled in series to form a first branch of the pulse circuit 52, where the components of the first branch may be configured to facilitate pulse current shaping and timing. Also, reference numeral 62 is representative or a pulse circuit current $I_{PULSE}$ that may flow through the pulse circuit 52.

In accordance with aspects of the present invention, the MEMS switch 20 may be rapidly switched (for example, on the order of picoseconds or nanoseconds) from a first closed state to a second open state while carrying a current albeit at a near-zero voltage. This may be achieved through the combined operation of the load circuit 40, and pulse circuit 52 including the balanced diode bridge 28 coupled in parallel across contacts of the MEMS switch 20.

Figure 3:
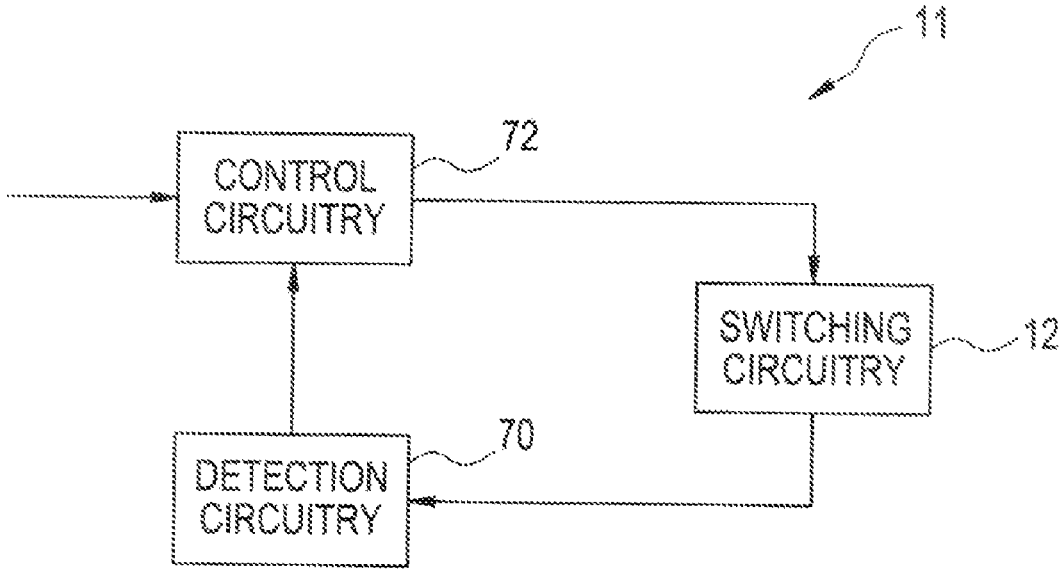
FIG. 3 is a block diagram of an exemplary MEMS based switching system in accordance with an embodiment of the invention and alternative to the system depleted in FIG. 1.

Reference is now made to FIG. 3, which illustrates a block diagram of an exemplary soft switching system 11, in accordance with aspects of the present invention. As illustrated in FIG. 3, the soft switching system 11 includes switching circuitry 12, detection circuitry 70, and control circuitry 72 operatively coupled together. The detection circuitry 70 may be coupled to the switching circuitry 12 and configured to detect an occurrence of a zero crossing of an alternating source voltage in a load circuit (hereinafter "source voltage") or an alternating current in the load circuit (hereinafter referred to as "load circuit current"). The control circuitry 72 may be coupled to the switching circuitry 12 and the detection circuitry 70, and may be configured to facilitate arc-less switching of one or more switches in the switching circuitry 12 responsive to a detected zero crossing of the alternating source voltage or the alternating load circuit current. In one embodiment, the control circuitry 72 may be configured to facilitate arc-less switching of one or more MEMS switches comprising at least part of the switching circuitry 12.

In accordance with one aspect of the invention, the soft switching system 11 may be configured to perform soft or point-on-wave (POW) switching whereby one or more MEMS switches in the switching circuitry 12 may be closed at a time when the voltage across the switching circuitry 12 is at or very close to zero, and opened at a time when the current through the switching circuitry 12 is at or close to zero. By closing the switches at a time when the voltage across the switching circuitry 12 is at or very close to zero, pre-strike arcing can be avoided by keeping the electric field low between the contacts of the one or more MEMS switches as they close, even if multiple switches do not all close at the same time. Similarly, by opening the switches at a time when the current through the switching circuitry 12 is at or close to zero, the soft switching system 11 can be designed so that the current in the last switch to open in the switching circuitry 12 falls within the design capability of the switch. As alluded to above and in accordance with one embodiment, the control circuitry 72 may be configured to synchronize the opening and closing of the one or more MEMS switches of the switching circuitry 12 with the occurrence of a zero crossing of an alternating source voltage or an alternating load circuit current.

Figure 4:
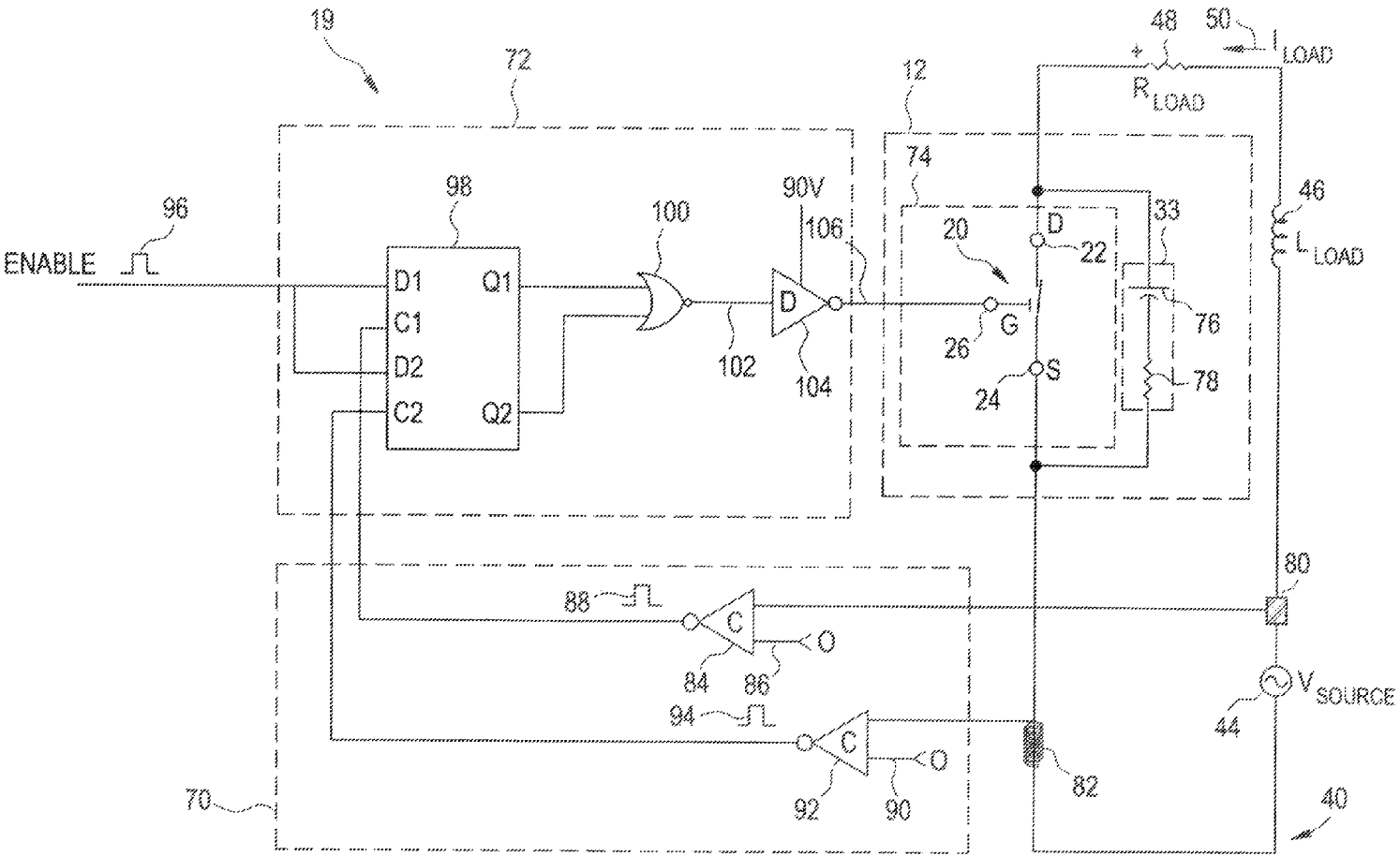
FIG. 4 is a schematic diagram illustrating the exemplary MEMS based switching system depicted in FIG. 3.

Turning to FIG. 4, a schematic diagram 19 of one embodiment of the soft switching system 11 of FIG. 3 is illustrated. In accordance with the illustrated embodiment, the schematic diagram 19 includes one example of the switching circuitry 12, the detection circuitry 70 and the control circuitry 72.

Although for the purposes of description. FIG. 4 illustrates only a single MEMS switch 20 in switching circuitry 12, the switching circuitry 12 may nonetheless include multiple MEMS switches depending upon, for example, the current and voltage handling requirements of the sob switching system 11. In one embodiment, the switching circuitry 12 may include a switch module Including multiple MEMS switches coupled together in a parallel configuration to divide the current amongst the MEMS switches. In another embodiment, the switching circuitry 12 may include an array of MEMS switches coupled in a series configuration to divide the voltage amongst the MEMS switches. In yet a further embodiment, the switching circuitry 12 may include an array of MEMS switch modules coupled together in a series configuration to concurrently divide the voltage amongst the MEMS switch modules and divide the current amongst the MEMS switches in each module. In one embodiment, the one or more MEMS switches of the switching circuitry 12 may be integrated into a single package 74.

The exemplary MEMS switch 20 may include three contacts. In one embodiment, a first contact may be configured as a drain 22, a second contact may be configured as a source 24, and the third contact may be configured as a gate 26. In one embodiment, the control circuitry 72 may be coupled to the gate contact 20 to facilitate switching a current state of the MEMS switch 20. Also, in certain embodiments, damping circuitry (snubber circuit) 33 may be coupled in parallel with the MEMS switch 20 to delay appearance of voltage across the MEMS switch 20. As illustrated, the damping circuitry 33 may include a snubber capacitor 76 coupled in series with a snubber resistor 78, for example.

Additionally, the MEMS switch 20 may he coupled in series with a load circuit 40 as further illustrated in FIG. 4. In a presently contemplated configuration, the load circuit 40 may include a voltage source $V_{SOURCE}$ 44, and may possess a representative load inductance $L_{LOAD}$ 46 and a load resistance $R_{LOAD}$ 48. In one embodiment, the voltage source $V_{SOURCE}$ 44 (also referred to as an AC voltage source) may be configured to generate the alternating source voltage and the alternating load current $I_{LOAD}$ 50.

As previously noted, the detection circuitry 70 may be configured to detect occurrence of a zero crossing of the alternating source voltage or the alternating load current $I_{LOAD}$ in the load circuit 40. The alternating source voltage may be sensed via the voltage sensing circuitry 80 and the alternating load current $I_{LOAD}$ 50 may be sensed via the current sensing circuitry 82. The alternating source voltage and the alternating load current may be sensed continuously or at discrete periods for example.

A zero crossing of the source voltage may be detected through, for example, use of a comparator such as the illustrated zero voltage comparator 84. The voltage sensed by the voltage sensing circuitry 80 and a zero voltage reference 86 may be employed as inputs to the zero voltage comparator 84. In turn, an output signal 88 representative of a zero crossing of the source voltage of the load circuit 40 may be generated. Similarly, a zero crossing of the load current $I_{LOAD}$ 50 may also be detected through use of a comparator such as the illustrated zero current comparator 92. The current sensed by the current sensing circuitry 82 and a zero current reference 90 may be employed as inputs to the zero current comparator 92. In turn, an output signal 94 representative of a zero crossing of the load current $I_{LOAD}$ 50 may be generated.

The control circuitry 72, may in turn utilize the output signals 88 and 94 to determine when to change (for example, open or close) the current operating state of the MEMS switch 20 for array of MEMS switches). More specifically, the control circuitry 72 may be configured to facilitate opening of the MEMS switch 20 in an arc-less manner to interrupt or open the load circuit 40 responsive to a detected zero crossing of the alternating load current $I_{LOAD}$ 50. Additionally, the control circuitry 72 may be configured to facilitate closing of the MEMS switch 20 in an arc-less manner to complete the load circuit 40 responsive to a detected zero crossing of the alternating source voltage.

In one embodiment, the control circuitry 72 may determine whether to switch the present operating state of the MEMS switch 20 to a second operating state based at least in part upon a state of an Enable signal 96. The Enable signal 96 may be generated as a result of a power off command in a contactor application, for example. In one embodiment, the Enable signal 96 and the output signals 88 and 94 may be used as input signals to a dual D flip-flop 98 as shown. These signals may be used to close the MEMS switch 20 at a first source voltage zero after the Enable signal 96 is made active (for example, rising edge triggered), and to open the MEMS switch 20 at the first load current zero after the Enable signal 96 is deactivated (for example, falling edge triggered). With respect to the illustrated schematic diagram 19 of FIG. 4, every time the Enable signal 96 is active (either high or low depending upon the specific implementation) and either output signal 88 or 94 indicates a sensed voltage or current zero, a trigger signal 102 may be generated. In one embodiment, the trigger signal 102 may be generated via a NOR gate 100, for example. The trigger signal 102 may in turn be passed through a MEMS gate driver 104 to generate a gate activation signal 106 which may be used to apply a control voltage to the gate 26 of the MEMS switch 20 (or gates in the case of a MEMS array).

As previously noted, in order to achieve a desirable current rating for a particular application, a plurality of MEMS switches may be operatively coupled in parallel (for example, to form a switch module) in lien of a single MEMS switch. The combined capabilities of the MEMS switches may be designed to adequately carry the continuous and transient overload current levels that may be experienced by the load circuit. For example, with a 10-amp RMS motor contactor with a 6× transient overload, there should be enough switches coupled in parallel to carry 60 amps RMS for 10 seconds. Using point-on-wave switching to switch the MEMS switches within 5 microseconds of reaching current zero, there will be 160 milliamps instantaneous, flowing at contact opening. Thus, for that application, each MEMS switch should be capable of "warm-switching" 160 milliamps, and enough of them should be placed in parallel to carry 60 amps. On the other hand, a single MEMS switch should be capable of interrupting the amount or level of current that will be flowing at the moment of switching.

Figure 5:
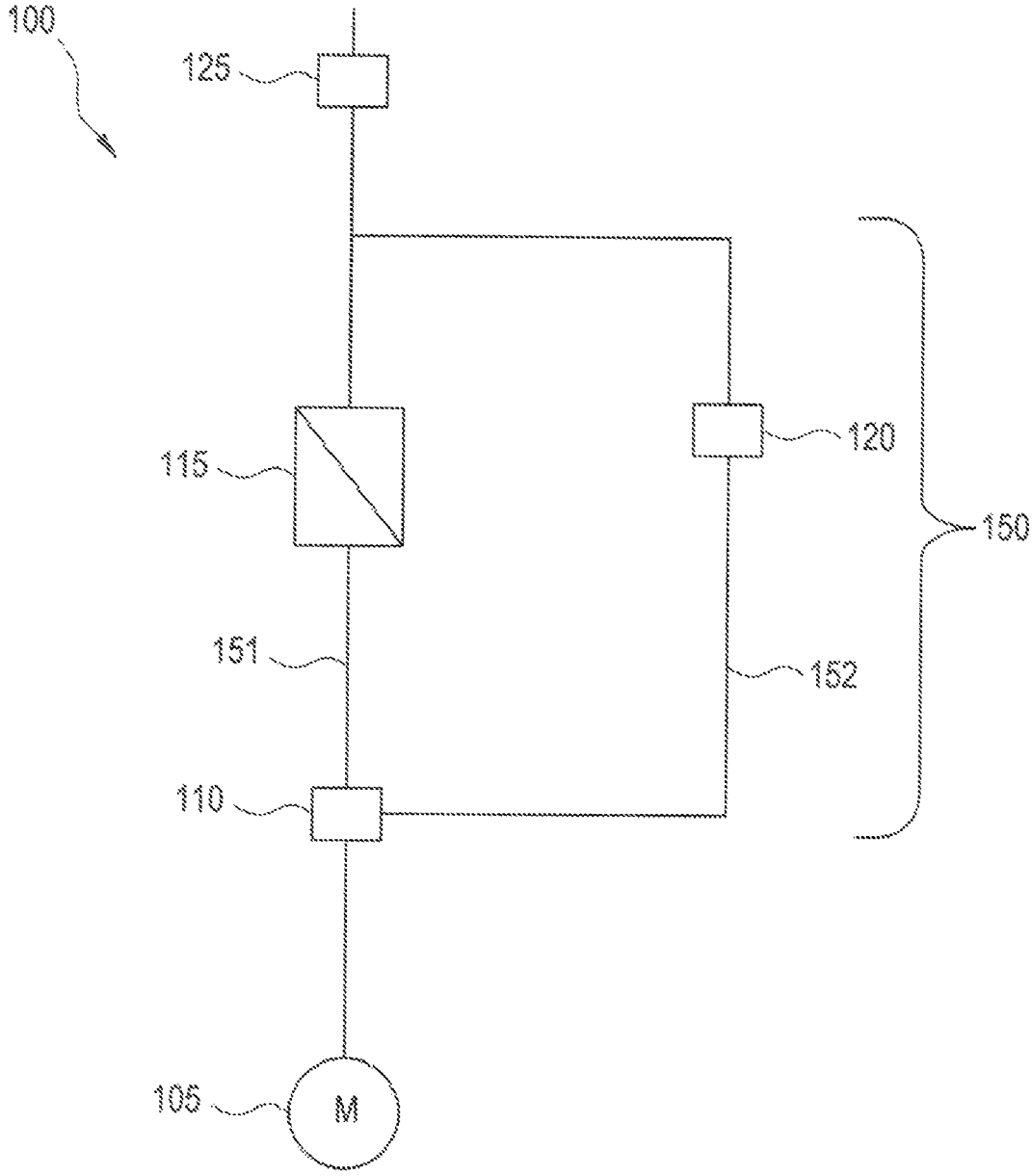
FIG. 5 is a schematic diagram illustrating an exemplary HVAC system having MEMS based switching system in accordance with exemplary embodiments.
Figure 6:
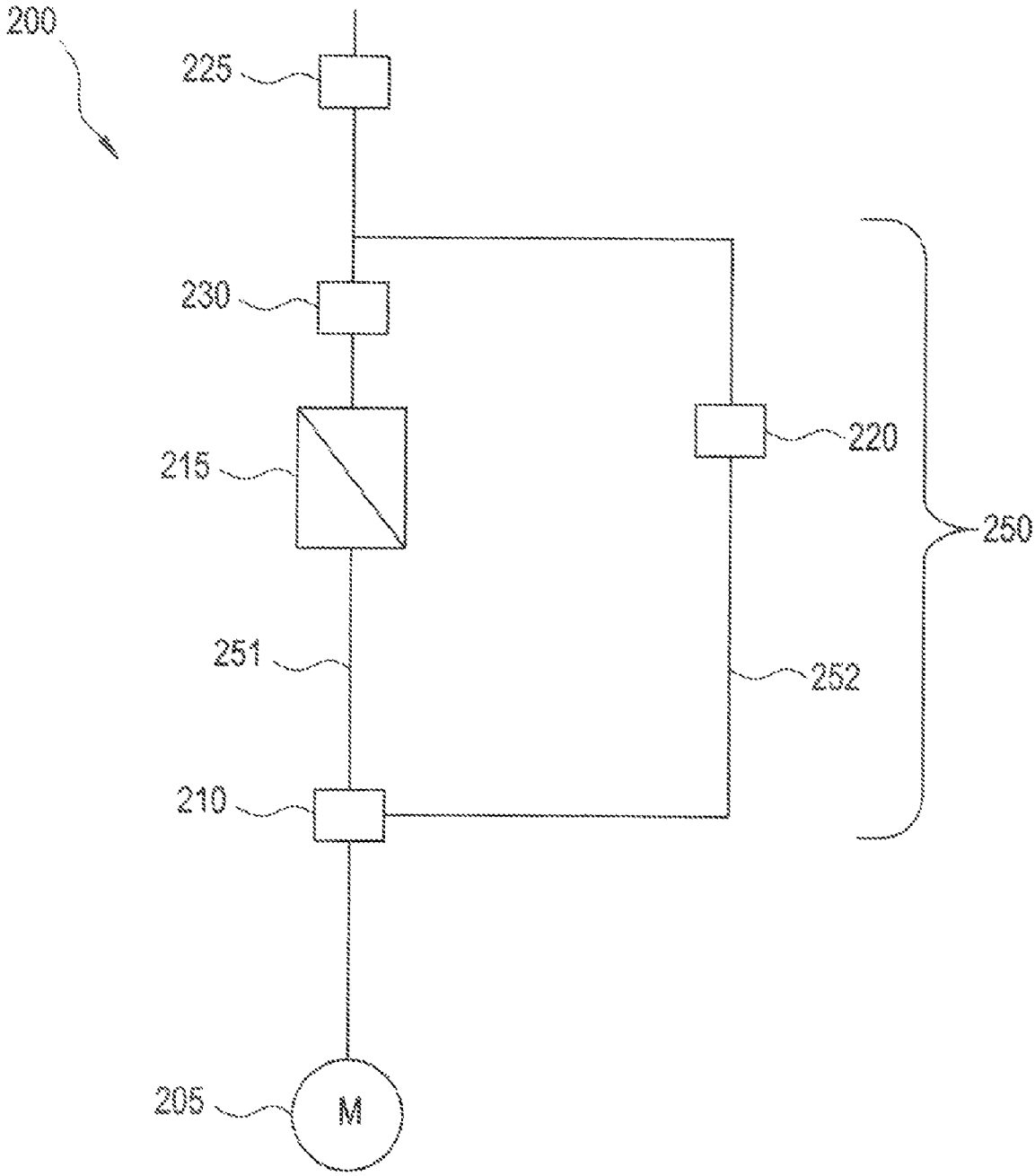
FIG. 6 is a schematic diagram illustrating an alternate exemplary HVAC system having MEMS based switching system in accordance with exemplary embodiments.

FIG. 5 is a schematic diagram illustrating an exemplary HVAC system 100 having a MEMS based switching system in accordance with exemplary embodiments. The system 100 depicted is a two-phase system. However, it is appreciated that the systems described herein can be two, three or more phase systems such as the three-phase system as depicted in FIG. 6 below.

In exemplary embodiments, the system 100 can include a load motor 105 coupled in series a two branch parallel circuit 150. It is appreciated that in conventional HVAC systems a fuse would be included in series between the load motor 105 and the two branch parallel circuit 150. Conventionally, fuses are provided to protect load motors and respective cabling from short circuits. As described herein the MEMS based switches render the fuse unnecessary, In exemplary embodiments, the first branch 151 can include a drive MEMS switch 110 in series with a variable frequency drive (VFD) 115. The second branch 152 can include a bypass MEMS switch 120. As mentioned above, the first and second branches 151, 152 form the parallel circuit 150. As mentioned, in exemplary embodiments, the drive MEMS switch 110 and the VFD 115 are electrically in series with one another. The series arrangement of the drive MEMS switch 110 and the VFD 115 are electrically parallel to the bypass MEMS switch 120.

In exemplary embodiments, the VFD 115 is an electronic device that provides variable speed control for the load motor 105. The VFD 115 for HVAC applications contains several auxiliary power handling components besides the core electronics to provide complete functionality. Conventionally, variable frequency drives similar to the VFD 115 can experience high incidents of fault currents for faults that occur downstream of the variable frequency drives. In exemplary embodiments, the VFD 115 enjoys reduced fault current for faults downstream of the VFD 115 and can result in reduced operating requirements of the VFD 115.

A main breaker MEMS switch 125 can be further coupled to the parallel circuit 150 upstream of the parallel circuit 150. The main breaker MEMS switch 125 provides isolation, protection, and control functions for all downstream components, including the load motor 105 and the VFD 115. The main breaker MEMS switch 125 can further provide switching functions and current limiting.

The main breaker MEMS switch 125, can include HALT to turn off and current limit and such as pulse-assisted-turn-on (PATO) to turn on. HALT and PATO are discussed further herein. In exemplary embodiments, the main breaker MEMS switch 105 provides aggressive current limiting action and total current interruption whenever a fault is detected anywhere in the HVAC system 100. In exemplary embodiments, depending on the location of the fault, the other MEMS components (e.g., the drive and bypass MEMS switches 110, 120, etc.) are reconfigured to isolate the fault. If the fault can be so isolated, the main breaker MEMS switch 125 is then quickly re-closed. The entire sequence of events can take ½ cycle.

In further exemplary embodiments, for a reconfigure operation (from normal to bypass or from bypass to normal), the above-described functionality is similar. In exemplary embodiments, the main breaker MEMS switch 125 interrupts power for ½ cycle while the configuration components (e.g., the drive and bypass MEMS switches 110, 120) are reconfigured. In turn, the power is restored ½ cycle later.

It is appreciated, that the implementation of the exemplary drive and bypass and main breaker 125 MEMS switches 110, 120 eliminates the conventional contactors. It is further appreciated that the drive, bypass and main breaker MEMS switches 110, 120, 125 have been illustrated and described as single switches. It is appreciated that in other exemplary embodiments, the drive, bypass and main breaker MEMS switches 110, 120, 125 can also be MES arrays of switches.

As discussed above, in exemplary embodiments, each of the drive, bypass and main breaker MEMS switches 110, 120, 125 can each include the control circuitry 72 such that the individual MEMS switches 110, 120, 125 can be independently controlled depending on the switch conditions as described herein. For example, the main breaker MEMS switch 125 can include the control circuitry 72 in which one of the switch conditions is a short circuit condition that could potentially damage the load motor 105 and the VFD 115.

In exemplary embodiments, the control circuitry 72 is further configured to measure parameters related to the electrical current passing through the HVAC system current paths such as through main breaker MEMS switch 125, and to compare the measured parameters with those corresponding to switch conditions, such as an amount of electrical current and time of an over-current event for example. In response to a parameter of electrical current with an instantaneous increase in electrical current of a magnitude great enough to indicate a short circuit, the control circuitry 72 generates a signal that causes the main breaker MEMS switch 125 to open and cause a transfer of short circuit energy from the main breaker MEMS switch 125 to the HALT device 14 (best seen with reference to FIG. 1) and thereby facilitate interruption of the electrical current passing through the current path. Additionally, in response to a parameter such as a defined duration of increase in the electrical current of a magnitude less than a short circuit, which can be indicative of a defined timed over-current fault, the control circuitry 72 likewise generates a signal that causes the main breaker MEMS swatch 125 to open and interrupt the electrical current.

In exemplary embodiments, the main breaker MEMS switch 125 can further include at least one of the HALT arc suppression circuit 14, voltage snubber circuit 33, and the soft-switching system 11 (also herein referred to as a soft-switching circuit) described above. It will be appreciated that the HALT arc suppression circuit 14, voltage snubber circuit 33, and soft-switching system 11 may be discrete circuits or integrated within the control circuitry 72. It is appreciated that in exemplary embodiments, the drive and bypass MEMS switches 110, 120 are not exposed to currents high enough to warrant the use of self-protection such as the HALT arc suppression circuit 14. As such, the drive and bypass MEMS switches 110, 120 (or microswitch arrays) can operate without the need for HALT or other self-protection such as PATO, because those functions are provided by the main breaker MEMS switch 125. Thus, the drive and bypass MEMS switches 110, 120 can be very simple because they can be cold-switched and generally do not experience a high withstand (a.k.a. let-through) current. However, it is further appreciated that in exemplary embodiments, the drive and bypass MEMS switch can also further include at least one of the HALT arc suppression circuit 14, voltage snubber circuit 33, and the soft-switching system 11.

In addition, the drive and bypass MEMS switches can include integrated controller circuitry 72 in order to drive or bypass the VFD, as now described.

In exemplary embodiments, bypass of the VFD is achieved with the drive and bypass MEMS switches 110, 120. To use the VFD 115, the control circuitry is implemented to close the drive MEMS switch 110 thereby activating the VFD 115. Separate electronics unique to the VFD 115 can be implemented in order to vary the drive frequency depending on the desired application. When using the VFD 115 as described, control circuitry 72 for the bypass MEMS switch 120 is implemented to open the bypass MEMS switch 120. In this way, no current flows through the second branch 152. Similarly, when it is desired to energize the load motor 105 directly from the power system, the drive MEMS switch 110 is opened and the bypass MEMS switch 120 is closed. It is appreciated that there is no need to run the VFD 115 in such an implementation when it is desired to run the load motor 105 at bill speed.

In exemplary embodiments, functions of the control circuitry 72 can further include time-based determinations, such as setting a trip-time curve based upon trip parameters of a switch condition, for example. The control circuit 72 further provides for voltage and current measurement, programmability or adjustability of each of the MEMS switches, control of the closing/re-closing logic of each of the MEMS switches, and in the case of the main breaker MEMS switch 125, interaction with the HALT device 14 to provide cold switching, or switching without arcing, for example. A power draw of the control circuit 72 is minimal and can be provided by line inputs, without a need to provide any additional external supply of power. The control circuitry 72 and the MEMS switches described herein may be configured for use with either alternating current (AC) or direct current (DC).

FIG. 6 is a schematic diagram illustrating an alternate exemplary HVAC system 200 having MEMS a based switching system in accordance with exemplary embodiments. The system 200 depicted is a three-phase system. However, as discussed above, it is appreciated that the systems described herein can be two, three or more phase systems.

In exemplary embodiments, the system 200 can include a load motor 205 coupled in series a two branch parallel circuit 250. It is appreciated that in conventional HVAC systems a fuse would be included in series between the load motor 205 and the two branch parallel circuit 250. As described above, the MEMS based switches render the use of a fuse unnecessary.

In exemplary embodiments, the first branch 251 can include a drive MEMS switch 210 in series with a VFD 215. The first branch can further include an isolate MEMS switch 230 in series with the drive MEMS switch 210 and the VFD 215. In exemplary embodiments, the isolate MEMS switch 230 is implemented to completely de-energize the VFD 215 during bypassed operation as discussed further below.

The second branch 252 can include a bypass MEMS switch 220. As mentioned above, the first and second branches 251, 252 form the parallel circuit 150. As mentioned, in exemplary embodiments, the drive MEMS switch 210 and the VFD 215 are electrically in series with one another. The series arrangement of the drive MEMS switch 210 and the VFD 215 are electrically parallel to the bypass MEMS switch 220.

In exemplary embodiments, the VFD 215 is an electronic device that provides variable speed control for the load motor 205. The VFD 215 for HVAC applications contains several auxiliary power handling components besides the core electronics to provide complete functionality. As discussed above, in exemplary embodiments, the VFD 215 enjoys reduced fault current for faults downstream of the VFD 215 and can result in reduced operating requirements of the VFD 215.

A main breaker MEMS switch 225 can be further coupled to the parallel circuit 250 upstream of the parallel circuit 250. The main breaker MEMS switch 225 provides isolation, protection, and control functions for all downstream components, including the load motor 205 and the VFD 215. The main breaker MEMS switch 225 can further provide switching functions and current limiting.

The main breaker MEMS switch 225, can include HALT to turn off and current limit and such as pulse-assisted-turn-on (PATO) to turn on. HALT and PATO are discussed further herein. In exemplary embodiments, the main breaker MEMS switch 205 provides aggressive current limiting action and total current interruption whenever a fault is detected anywhere in the HVAC system 200. In exemplary embodiments, depending on the location of the fault, the other MEMS components (e.g., the drive, bypass and isolate MEMS switches 210, 220, 230, etc.) are reconfigured to isolate the fault. If the fault can be so isolated, the main breaker MEMS switch 225 is then quickly re-closed. The entire sequence of events can take ½ cycle.

In further exemplary embodiments, for a reconfigure operation (from normal to bypass or from bypass to normal), the above-described functionality is similar. In exemplary embodiments, the main breaker MEMS switch 225 interrupts power for ½ cycle while the configuration components (e.g., the drive and bypass MEMS switches 110, 120) am reconfigured. In turn, the power is restored ½ cycle later.

As discussed above, in exemplary embodiments, each of the drive, bypass, isolate and main breaker MEMS switches 210, 220, 230, 225 can each include the control circuitry 72 such that the individual MEMS switches 210, 220, 230, 225 can be independently controlled depending on the switch conditions as described herein. For example, the main breaker MEMS switch 225 can include the control circuitry 72 in which one of the switch conditions is a short circuit condition that could potentially damage the load motor 105 and the VFD 215.

In exemplary embodiments, the control circuitry 72 is further configured to measure parameters related to the electrical current passing through the HVAC system current paths such as through main breaker MEMS switch 225, and to compare the measured parameters with those corresponding to switch conditions, such as an amount of electrical current and time of an over-current event for example. In response to a parameter of electrical current with an instantaneous increase in electrical current of a magnitude great enough to indicate a short circuit, the control circuitry 72 generates a signal that causes the main breaker MEMS switch 225 to open and cause a transfer of short circuit energy from the main breaker MEMS switch 225 to the HALT device 14 (best seen with reference to FIG. 1) and thereby facilitate interruption of the electrical current passing through the current path. Additionally, in response to a parameter such as a defined duration of increase in the electrical current of a magnitude less than a short circuit, which can be indicative of a defined timed overcurrent fault, the control, circuitry 72 likewise generates a signal that causes the main breaker MEMS switch 225 to open and interrupt the electrical current.

In exemplary embodiments, the main breaker MEMS switch 225 can further include at least one of the HALT arc suppression circuit 14, voltage snubber circuit 33, and the soft-switching system 11 (also herein referred to as a soft-switching circuit) described above. It will be appreciated that the HALT arc suppression circuit 14, voltage snubber circuit 33, and soft-switching system 11 may be discrete circuits or integrated within the control circuitry 72. It is appreciated that in exemplary embodiments, the drive, bypass and isolate MEMS switches 210, 220, 230 are not exposed to currents high enough to warrant the use of self-protection such as the HALT arc suppression circuit 14. As such, the drive, bypass and isolate MEMS switches 210, 220, 230 (or microswitch arrays) can operate without the need for HALT or other self-protection such as PATO, because those functions are provided by the main breaker MEMS switch 225. Thus, the drive, bypass and isolate MEMS switches 210, 220, 230 can be very simple because they can be cold-switched and generally do not experience a high withstand (a.k.a. let-through) current. However, it is further appreciated that in exemplary embodiments, the drive and bypass MEMS switch can also further include at least one of the HALT arc suppression circuit 14, voltage snubber circuit 33, and the soft-switching system 11.

In exemplary embodiments, bypass of the VFD 215 is achieved with the drive, bypass and isolate MEMS switches 210, 220, 230. To use the VFD 215, the control circuitry 72 is implemented to close the drive MEMS switch 210 thereby activating the VFD 215. Separate electronics unique to the VFD 215 can be implemented in order to vary the drive frequency depending on the desired application. When using the VFD 215 as described, control circuitry 72 for the bypass MEMS switch 220 is implemented to open the bypass MEMS switch 220. In this way, no current flows through the second branch 252. Similarly, when it is desired to energize the load motor 205 directly from the power system, the drive MEMS switch 210 is opened and the bypass MEMS switch 220 is closed. It is appreciated that there is no need to run the VFD 215 in such an implementation when it is desired to run the load motor 205 at full speed.

In further exemplary embodiments, in order to completely de-energize the VFD 215, the bypass MEMS switch can be closed as described. In addition, the drive MEMS switch 210 can be open. Furthermore, the isolate MEMS switch 230 can further be opened, the result of which is complete isolation of the VFD 215. As discussed above, it is appreciated that respective control circuitry 72 is implemented to trigger the switch conditions (i.e., closing the bypass MEMS switch 220, and opening the drive MEMS switch 210 and the isolate MEMS switch 230, etc.)

In exemplary embodiments, functions of the control circuitry 72 can further include time-based determinations, such as setting a trip-time curve based upon trip parameters of a switch condition, for example. The control circuit 72 further provides for voltage and current measurement, programmability or adjustability of each of the MEMS switches, control of the closing/re-closing logic of each of the MEMS switches, and in the case of the main breaker MEMS switch 225, interaction with the HALT device 14 to provide cold switching, or switching without arcing, for example. A power draw of the control circuit 72 is minimal and can be provided by line inputs, without a need to provide any additional external supply of power. The control circuitry 72 and the MEMS switches described herein may be configured for use with either alternating current (AC) or direct current (DC).

In view of the foregoing, it will be appreciated that embodiments of the HVAC systems described herein can eliminate all conventional HVAC components, including the main circuit breaker, the contactors. Their functions can be achieved with MEMS switches and micros witch arrays. The switches and arrays can achieve the equivalent protection and bypass functions in a much more reliable, quiet, compact, and lightweight manner, with better protection during faults.

While the invention has been described with reference to exemplary embodiments it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, them have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A HVAC system, comprising:

a load motor;

a main breaker micro electromechanical system (MEMS) switch;

a voltage snubber circuit electrically coupled to the main breaker MEMS switch; and a variable frequency drive (VFD) disposed between and electrically coupled to the load motor and the main breaker MEMS switch.

2. A HVAC system, comprising:

a load motor;

a main breaker micro electromechanical system (MEMS) switch;

a soft-switching circuit to synchronize a change in state of the main breaker MEMS switch; and a variable frequency drive (VFD) disposed between and electrically coupled to the load motor and the main breaker MEMS switch.

3. The system as claimed in claim 2 further comprising a drive MEMS switch electrically coupled to and disposed between the load motor and the VFD.

4. The system as claimed in claim 2 further comprising control circuitry electrically coupled to the main breaker MEMS switch, the control circuitry configured to facilitate switch conditions triggered in the main breaker MEMS switch.

5. The system as claimed in claim 2, further comprising a Hybrid Arcless Limiting Technology (HALT) arc suppression circuit disposed in electrical communication with the main breaker MEMS switch to receive a transfer of electrical energy from the main breaker MEMS switch in response to a switch condition that triggers the main breaker MEMS.

6. The system as claimed in claim 3 wherein the drive MEMS switch is configured to be triggered by a switch condition including at least one of a closed state to drive the VFD and an open state to bypass the VFD.

7. The system as claimed in claim 3 wherein the drive MEMS switch and the VFD are electrically in series.

8. The system as claimed in claim 3 further comprising a bypass MEMS switch electrically parallel to the VFD and the drive MEMS switch.

9. The system as claimed in claim 3 wherein the VFD is disposed between the drive MEMS switch and an isolate MEMS switch.

10. The system as claimed in claim 8 wherein the bypass MEMS switch is configured to be triggered by a switch condition including at least one of a closed state to bypass the VFD and an open state to drive the VFD.

11. The system as claimed in claim 9 wherein the drive and isolate MEMS switches are configured to be triggered into an open state to electrically de-energize the VFD.

12. A HVAC system, comprising:

a load motor;

a main breaker micro electromechanical system (MEMS) switch;

a soft-switching circuit to synchronize a change in state of the main breaker MEMS switch;

a first MEMS switch branch coupled between the load motor and the main breaker MEMS switch;

a second MEMS switch branch coupled between the load motor and the main breaker MEMS switch, and electrically arranged in parallel to the first MEMS switch branch;

a variable frequency drive (VFD) disposed on the first MEMS switch branch;

a drive MEMS switch disposed on the first MEMS switch branch and in electrical series with the VFD; and a bypass MEMS switch disposed on the second MEMS switch branch.

13. The system as claimed in claim 12 further comprising a control circuit further coupled to each of the MEMS switches, the control circuit configured to facilitate switch conditions triggered in MEMS switches.

14. The system as claimed in claim 13 wherein the switch conditions include at least one of short circuits and VFD control.

15. The system as claimed in claim 13, further comprising a Hybrid Arcless Limiting Technology (HALT) arc suppression circuit disposed in electrical communication with the main breaker MEMS switch to receive a transfer of electrical energy from the main breaker MEMS switch in response to a switch condition that triggers the main breaker MEMS.

16. A HVAC system, comprising:

a load motor;

a main breaker micro electromechanical system (MEMS) switch;

a soft-switching circuit to synchronize a change in state of the main breaker MEMS switch;

a first MEMS switch branch coupled between the load motor and the main breaker MEMS switch;

a drive MEMS switch disposed on the first MEMS switch branch;

an isolate MEMS switch disposed on the first MEMS switch branch;

a variable frequency drive (VFD) disposed on the first MEMS switch branch and between and in electrical series with the drive and isolate MEMS switches;

a second MEMS switch branch coupled between the load motor and the main breaker MEMS switch, and electrically arranged in parallel to the first MEMS switch branch; and a bypass MEMS switch disposed on the second MEMS switch branch.

17. The system as claimed in claim 16 further comprising a control circuit further coupled to each of the MEMS switches, the control circuit configured to facilitate switch conditions triggered in MEMS switches.

18. The system as claimed in claim 17 wherein the switch conditions include at least one of short circuits and VFD control.

19. The system as claimed in claim 17, further comprising a Hybrid Arcless Limiting Technology (HALT) arc suppression circuit disposed in electrical communication with the main breaker MEMS switch to receive a transfer of electrical energy from the main breaker MEMS switch in response to a switch condition that triggers the main breaker MEMS.

20. A HVAC system, comprising:

a load motor;

a main breaker micro electromechanical system (MEMS) switch;

a voltage snubber circuit electrically coupled to the main breaker MEMS switch;

a first MEMS switch branch coupled between the load motor and the main breaker MEMS switch;

a second MEMS switch branch coupled between the load motor and the main breaker MEMS switch, and electrically arranged in parallel to the first MEMS switch branch;

a variable frequency drive (VFD) disposed on the first MEMS switch branch;

a drive MEMS switch disposed on the first MEMS switch branch and in electrical series with the VFD; and a bypass MEMS switch disposed on the second MEMS switch branch.

21. A HVAC system, comprising:

a load motor;

a main breaker micro electromechanical system (MEMS) switch;

a voltage snubber circuit electrically coupled to the main breaker MEMS switch;

a first MEMS switch branch coupled between the load motor and the main breaker MEMS switch;

a drive MEMS switch disposed on the first MEMS switch branch;

an isolate MEMS switch disposed on the first MEMS switch branch;

a variable frequency drive (VFD) disposed on the first MEMS switch branch and between and in electrical series with the drive and isolate MEMS switches;

a second MEMS switch branch coupled between the load motor and the main breaker MEMS switch, and electrically arranged in parallel to the first MEMS switch branch; and a bypass MEMS switch disposed on the second MEMS switch branch.

* * * * *